US005941473A

United States Patent [19]

Kawano et al.

[11] Patent Number: 5,941,473

[45] **Date of Patent: *Aug. 24, 1999**

[54] APPARATUS FOR WINDING UP A STRIP OF THIN MATERIAL

[75] Inventors: Gouya Kawano; Tsutomu Matsumura; Yutaka Yumiya, all of Fuchu-cho, Japan

[73] Assignee: Fuji Kikai Kogyo Co., Ltd., Hiroshima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/685,663

[22] Filed: Jul. 24, 1996

[30] Foreign Application Priority Data

Jul. 25, 1995 [JP] Japan ..... 7-189517

[51] Int. Cl.[6] ..... B65H 23/18

[52] U.S. Cl. ..... 242/413.1

[58] Field of Search ..... 242/413.1, 413.2, 242/413.4, 413.5, 334.2, 334.5, 334.6

[56] References Cited

U.S. PATENT DOCUMENTS

| | | | |
|---|---|---|---|
| 3,563,485 | 2/1971 | Phillips | 242/413.5 |
| 3,650,490 | 3/1972 | Saunders | 242/413.2 X |
| 3,792,826 | 2/1974 | Zebley | 242/413.2 |
| 3,921,043 | 11/1975 | Luzio | 318/7 |
| 4,651,941 | 3/1987 | Muller | 242/59 |

FOREIGN PATENT DOCUMENTS

| | | |
|---|---|---|
| 0 593 946 A2 | 4/1994 | European Pat. Off. . |
| 0 593 946 A3 | 4/1994 | European Pat. Off. . |
| 3432211 | 1/1984 | Germany . |
| 3602745 | 1/1986 | Germany . |
| 62-176142 | 9/1987 | Japan . |
| 5 85651 | 4/1993 | Japan . |
| 2057492 | 11/1970 | United Kingdom . |
| 2112901 | 3/1971 | United Kingdom . |
| 2313461 | 3/1973 | United Kingdom . |

OTHER PUBLICATIONS

Patent Abstracts of Japan, vol. 8, No. 104 (M–296), May 16, 1984 and JP–A–59 017450 (Sumimoto Jukikai Kogyo KK), Jan. 28, 1984, abstract; figures 1,2 only.

Mathew E. Girash, Programmable Digital Winder Drives, Sep. 27, 1989, Atlanta, Georgia, USA.

*Primary Examiner*—John Q. Nguyen

*Attorney, Agent, or Firm*—Fish & Richardson P.C.

[57] ABSTRACT

A thin material winding apparatus includes: a winding shaft for winding up a strip of thin material; a drive motor for driving the winding shaft; and a control unit for controlling the drive motor in such a way that the product of a diameter of a rolled thin material on the winding shaft and a tension exerting on the thin material is constant during a specified winding period. The control unit is provided with a diameter detecting device for detecting a diameter of the rolled thin material; a memory for storing a relationship between a target tension and a diameter of the rolled thin material to make the product of a diameter of the rolled thin material and a tension on the thin material constant; a target tension readout device for reading out a target tension in accordance with a detection of the diameter detecting device; and a drive motor control portion for controlling the drive motor so that the thin material has a tension agreeing with the target tension.

12 Claims, 7 Drawing Sheets

APPARATUS FOR WINDING UP A STRIP OF THIN MATERIAL

BACKGROUND OF THE INVENTION

This invention relates to an apparatus for winding up a strip of thin material such as paper, plastic film, and laminated material into a roll.

Japanese Unexamined Patent Publication No. 5-270704 discloses a winding apparatus in which a strip of thin material is wound about a winding shaft by rotating the winding shaft. This winding apparatus comprises a crown touch roller having a crown portion or bulged surface in an axially intermediate portion thereof and a spur touch roller having a straight outer surface parallel with the axis thereof. The crown touch roller and the spur touch roller are rotated while being brought into pressing contact with the thin material being wound up by the shaft.

The combination of the crown and spur touch rollers constitutes an arrangement to expel the air from rolled layers and prevent the air from coming into rolled layers. Specifically, the bulged intermediate portion of the crown touch roller comes into pressing contact with an axially intermediate portion of the rolled material to expel the air from the rolled layers. Also, the spur touch roller comes into pressing contact with the rolled material over the entire width to further expel the air from rolled layers.

The conventional apparatus can prevent a poor roll of thin material containing the air in layers. However, this apparatus cannot prevent a slip between rolled layers which is liable to occur in the case of slippery thin material such as plastic film.

More specifically, in winding up a thin material, the so-called "layer slip" is liable to occur that rolled layers are slipped one over another during the winding operation, particularly in a radially middle portion of the roll. This has been understood to occur when the tension exerting on the thin material 1 is larger than a frictional resistance between rolled layers. Such layer slip results in a poor roll of thin material having irregularities on its side end surfaces.

In order to prevent the layer slip, there have been taken a countermeasure of controlling the drive motor of driving the winding shaft to reduce step-by-step the tension on the thin material being wound up about the shaft, and another countermeasure of controlling the drive motor in accordance with a pre-set program to linearly reduce the tension on the thin material in accordance with an increase in the diameter of the rolled thin material. However, in the case of winding up a strip of thin material having a small friction coefficient, there has still been the difficulty in controlling the drive motor to completely prevent the layer slip to ensure a smooth side end surface of a finished roll of thin material.

SUMMARY OF THE INVENTION

It is an object of the present invention to provide an apparatus for winding up a strip of thin material which has overcome the above problems residing in the prior art.

It is another object of the present invention to provide an apparatus for winding up a strip of thin material which can prevent any layer slip even in the case of thin material having a small coefficient of friction.

The present invention is directed to a thin material winding apparatus, comprising: a winding shaft for winding up a strip of thin material; a drive motor for driving the winding shaft; and a control unit for controlling the drive motor in such a way that the product of a diameter of a rolled thin material on the winding shaft and a tension exerting on the thin material is constant during a specified winding period.

The control unit may be provided with a diameter detecting device for detecting a diameter of the rolled thin material, a memory for storing a relationship between a target tension and a diameter of the rolled thin material to make the product of a diameter of the rolled thin material and a tension on the thin material constant, a target tension readout device for reading out a target tension in accordance with a detection of the diameter detecting device, and a drive motor control portion for controlling the drive motor so that the thin material has a tension agreeing with the target tension.

It may be appreciated to further provide a tension detecting device for detecting a tension on the thin material. In this case, the drive motor control portion controls the drive motor based on a detection of the tension detecting device.

Also, the memory may be preferably stored with an initial target tension having a constant value for an initial winding stage of winding the thin material on the winding shaft up to a predetermined diameter.

Further, it may be appreciated that the control unit is provided with an input device for inputting an initial target tension, a calculator for calculating a target tension based on the input initial target tension, and a memory for storing the calculated target tension.

With the thus constructed thin material winding apparatus, the drive motor is controlled in such a way that the product of a diameter of a rolled thin material and a tension on the thin material is constant during a specified winding period. Accordingly, the winding torque can be easily controlled not to exceed a specified value to prevent the layer slip. Thus, a roll of thin material having a smooth side end surface can be reliably produced.

Also, the control unit may be provided with the memory for storing a relationship between a target tension and a diameter of the rolled thin material to make the product of a diameter of the rolled thin material and a tension on the thin material constant. The drive motor is controlled to make the thin material having a tension agreeing with the target tension. This will ensure a quick control of the drive motor in accordance with an increased diameter of the rolled thin material.

Further, there is provided the tension detecting device. The drive motor is controlled based on a detection of the tension detecting device. Accordingly, even if the load to the drive motor varies with a variation in the weight of the rolled thin material or the voltage of power source fluctuates, the drive motor 4 can be properly controlled.

The memory is stored with an initial target tension having a constant value for an initial winding stage. This will assure firm winding of thin material without causing any break or any plastic deformation in the thin material, thereby producing a roll of thin material having a good appearance.

Moreover, in the case that the control unit is provided with the calculator for calculating a target tension based on the input initial target tension, a target tension value suitable to a given thin material can be set more accurately. This will ensure more precise winding control.

Other objects, features and advantages of the invention will be understood upon reading the detailed description of the invention to follow in conjunction with the accompanying drawings.

DETAILED DESCRIPTION OF THE PREFERRED EMBODIMENTS OF THE INVENTION

Figure 1:
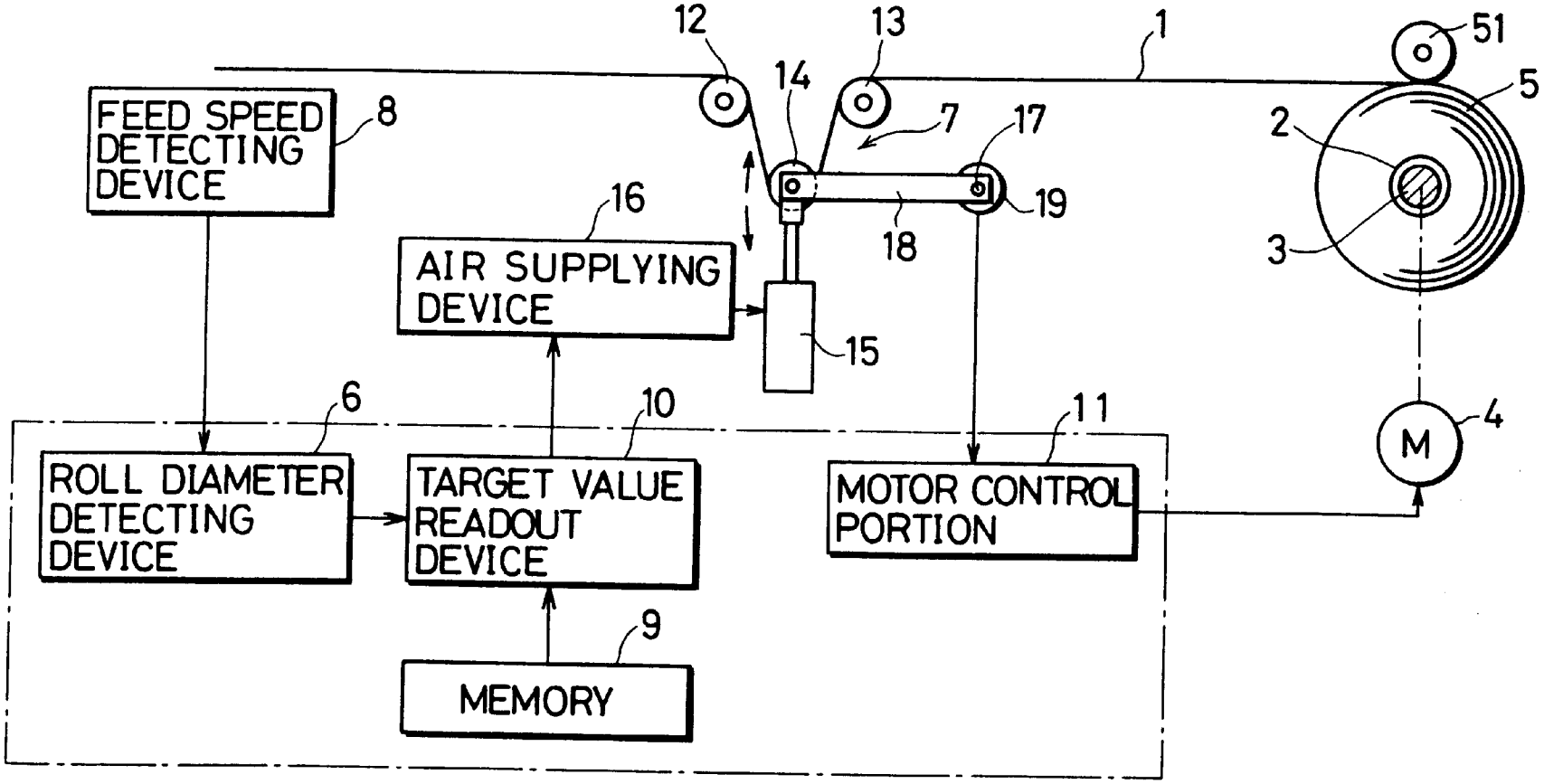
FIG. 1 is a diagram showing a construction of a thin material winding apparatus according to the invention.

FIG. 1 is a diagram showing a schematic construction of a thin material winding apparatus according to the invention. This apparatus comprises a winding shaft 3 attachably and detachably mounted with a pipe 2 made of paper around which a thin material 1 is to be wound, a drive motor 4 for drivingly rotating the shaft 3, a roll diameter detecting device 6 for detecting a diameter of a rolled thin material 5 on the pipe 2, a tension detecting device 7 for detecting a tension acting on the thin material 1, a feed speed detecting device 8 for detecting a speed at which the thin material 1 is fed, and a touch roller (pressing roller) 51 operable to come into pressing contact with the thin material 1 during winding operation of the thin material 1.

The winding apparatus further comprises a control unit including a memory 9 for storing a target tension value at which the thin material 1 is to be wound up in advance in correspondence to the diameter of the rolled thin material 5, a target tension value readout device 10 for reading out a target tension value stored in the memory 9 based on a detection signal output from the roll diameter detecting device 6, and a motor control portion 11 for controlling the drive motor 4 based on a detection signal from the tension detecting device 7 so that the tension on the thin material 1 coincides with the readout target tension value.

The drive motor 4 is a synchronous machine type AC servo motor (SM-type AC servo motor), an induction machine type AC servo motor (IM-type AC servo motor), or a direct current motor. An electric current or voltage for driving the motor is controlled by a control signal output from the motor control portion 11 to control the driving torque of the motor 4 as will be described later.

The roll diameter detecting device 6 calculates an outer diameter of the rolled thin material 5 on the pipe 2 based on a feed speed of thin material detected by the feed speed detecting device 8, an operation time period of the apparatus measured by an unillustrated measuring device, a thickness of the thin material 1 input by an unillustrated input device, and a diameter of the pipe 2.

In the case where the feed speed, thickness of the thin material 1, and the diameter of the pipe 2 are known in advance, the diameter of the rolled thin material 5 can be read out based on the measurement value of the measuring device using a table showing a correspondence between the operation time period of the apparatus and the diameter of the rolled thin material 5 which is set in advance, without the provision of the feed speed detecting device 8 and input device. Alternatively, the outer diameter of the rolled thin material 5 may be directly measured using a sensor.

The tension detecting device 7 comprises a pair of support rollers 12 and 13 for supporting the thin material 1 being fed by a feeding device, a dancer roller 14 disposed at a specified position between the support rollers 12 and 13 for applying a pulling force to the thin material 1 to keep the tension on the thin material at a constant level, an air cylinder 15 for moving the dancer roller 14, an air pressure setting device 16 for setting an air pressure for the air cylinder 15, a support arm 18 rotatable about a pivot 17 for pivotally supporting the dancer roller 14, and a dancer roller position detecting device 19 for detecting a position of the dancer roller 14 based on a rotational angle of the support arm 18.

The pressure setting device 16 sets a drive air pressure for the air cylinder 15 corresponding to a target tension value which is read out from the readout device 10 of the control unit, thereby driving the air cylinder 15 to give the dancer roller 14 a pulling force to keep the dancer roller 14 in a neutral position, i.e., to keep the support arm 18 in a horizontal posture. It should be appreciated that the correspondence between the drive air pressure for the air cylinder 15 and the tension on the thin material 1 is calculated in advance through experiments.

The position of the dancer roller 14 varies in follow with a pulling force of the air cylinder 15 for the dancer roller 14 and a tension on the thin material 1. Accordingly, a tension on the thin material 1 is detected by detecting a position of the dancer roller 14. For example, let it be assumed that a pulling force corresponding to a tension of 100N is applied from the air cylinder 15 to the dancer roller 14. In this case, it can be detected whether the thin material 1 is subjected to a tension of 100N on the basis of a detection as to whether the dancer roller 14 is in the neutral position.

More specifically, if the tension on the thin material 1 is smaller than 100N, the dancer roller 14 pivotally rotates downward below the neutral position because the pulling force of the air cylinder 15 is larger than the tension on the thin material 1. Accordingly, based on the downward rotation, it is judged that the tension on the thin material 1 is smaller than 100N.

On the contrary, if the tension on the thin material 1 is larger than 100N, the dancer roller 14 pivotally rotates upward above the neutral position because the pulling force of the air cylinder 15 is smaller than the tension on the thin material 1. Accordingly, based on the upward rotation, it is judged that the tension on the thin material 1 is larger than 100N.

Further, it is possible to detect a difference between an actual tension on the thin material 1 and a target tension value (the pulling force of the air cylinder 15 for the dancer roller 14) based on a displaced amount of the dancer roller 14 with respect to the neutral position.

Figure 2:
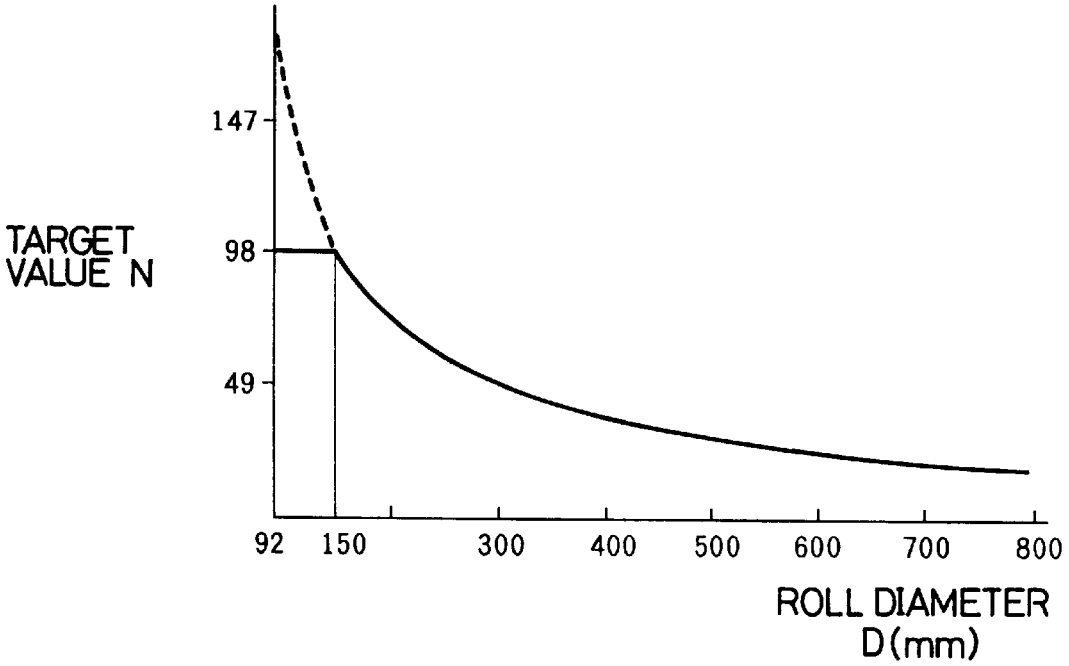
FIG. 2 is a graph showing a relationship between a target value of tension and a diameter of a rolled thin material in the winding apparatus.

The memory 9 stores a relationship between a target tension value N and a diameter D of the rolled thin material 5 which is shown in FIG. 2. The relationship is determined in advance. In an initial winding stage, the target tension value N is kept at a constant value of 98N until the diameter D of the rolled thin material 5 reaches a predetermined reference value of 150 mm. The reference value of 150 mm includes a diameter of the pipe 2 of 92 mm and a thickness of the initially rolled thin material 5 of 58 mm.

When the diameter D of the rolled thin material 5 exceeds the reference value, the target tension value N is reduced with an increase in the diameter D of the rolled thin material 5 so that the product of a diameter D and a target tension value N is constant. In other words, the target tension value N is reduced with an increased diameter D of the rolled thin material 5.

The target tension value readout device 10 reads out a target tension value N stored in the memory 9 in correspondence to a diameter D of the rolled thin material 5 which is detected by the roll diameter detecting device 6, then outputs a control signal corresponding to the target tension value to the pressure setting device 16 of the tension detecting device 7. The pressure setting device 16 causes the air cylinder 15 to generate a pulling force corresponding to the target tension value N.

The motor control portion 11 controls the drive motor 4 so that an actual tension on the thin material 1 coincides with a target tension value N in accordance with a position of the dancer roller 14 of the tension detecting device 7.

For instance, when it is detected that an actual tension F on the thin material 1 is smaller than the pulling force of the air cylinder 15 corresponding to the target tension value, i.e., when the dancer roller 14 moves downward below the neutral position, a control signal to increase the driving torque of the drive motor 4 is output to the motor 4 to thereby increase the tension F on the thin material 1.

The thin material winding apparatus of the present invention is operated as follows.

The pipe 2 is mounted on the shaft 3 and a free end of a thin material 1 is fixedly attached on a surface of the pipe 2. Thereafter, the drive motor 4 is driven to rotate the shaft 3 and the pipe 2. In this time, a suitable pressing force is applied to the thin material 1 being wound with the pressing roller 51. In this initial stage of winding operation, the target tension value N of 98N is read out from the memory 9 by the target tension value readout device 10 and sent to the pressure setting device 16.

The driving torque of the drive motor 4 is feedback controlled in accordance with a detection signal of the tension detecting device 7 to retain the dancer roller 14 at the neutral position. In this way, the thin material 1 is wound on the pipe 2 while the tension on the thin material 1 is being kept at the target tension value.

In the stage where the diameter D of the rolled thin material 5 becomes larger than the reference value of 150 mm, the target tension value readout device 10 reads out a target tension value N corresponding to a varied diameter D in accordance with the predetermined inversely proportional curve that the diameter D varies inversely with the target tension value N, i.e., the product of the diameter D and the target tension value N is constant.

The readout device 10 sends a control signal corresponding to the a read target tension value to the pressure setting device 16 which in turn causes the air cylinder 15 to generate a pulling force corresponding to the target tension value.

Figure 3:
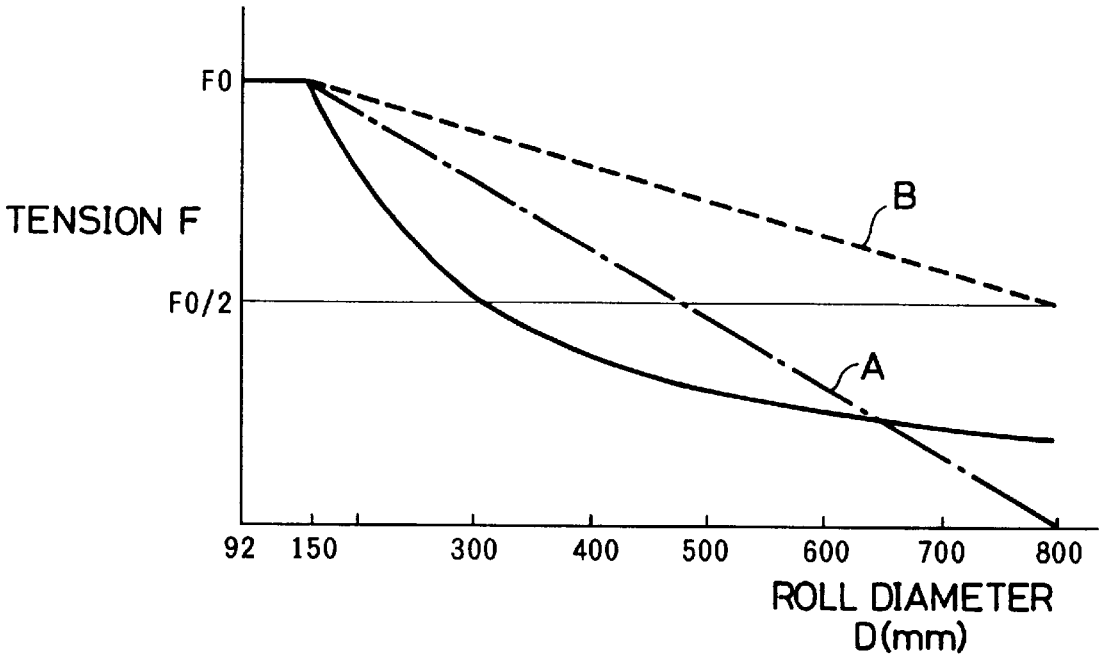
FIG. 3 is a graph showing a relationship between a tension and a diameter of the rolled thin material in the winding apparatus.

Also, the drive motor 4 is feedback controlled by the motor control portion 11 in responsive to the dance roller position detecting device 19 to reduce the tension F on the thin material 1 in inverse proportion to the diameter D of the rolled thin material 5 as shown in FIG. 3. After the diameter D of the roller thin material 5 exceeds the reference value, the driving torque of the drive motor 4 is controlled by the motor control portion 11 in such a way that the tension F on the thin material 1 decreases with an increase in the diameter D of the rolled thin material 5 and the product of the tension F and the diameter D is constant. The control of the drive motor 4 is carried out in accordance with a variation in the position of the dancer roller 14. Accordingly, even when a thin material having a small friction coefficient is wound, the layer slip can be assuredly prevented.

As shown by the solid line in FIG. 3, in the winding apparatus according to the present invention, a target tension value N is set in accordance with the inversely proportional curve to make the product of the diameter D and the tension F constant after the diameter D exceeds the reference value. This will make the winding torque T of winding the thin material 1 constant as shown by the solid line in FIG. 4.

Figure 5:
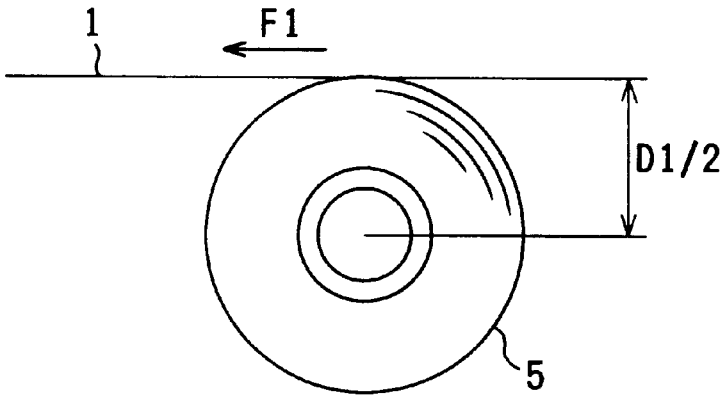
FIG. 5 is a diagram showing an intermediate winding stage of the thin material.
Figure 6:
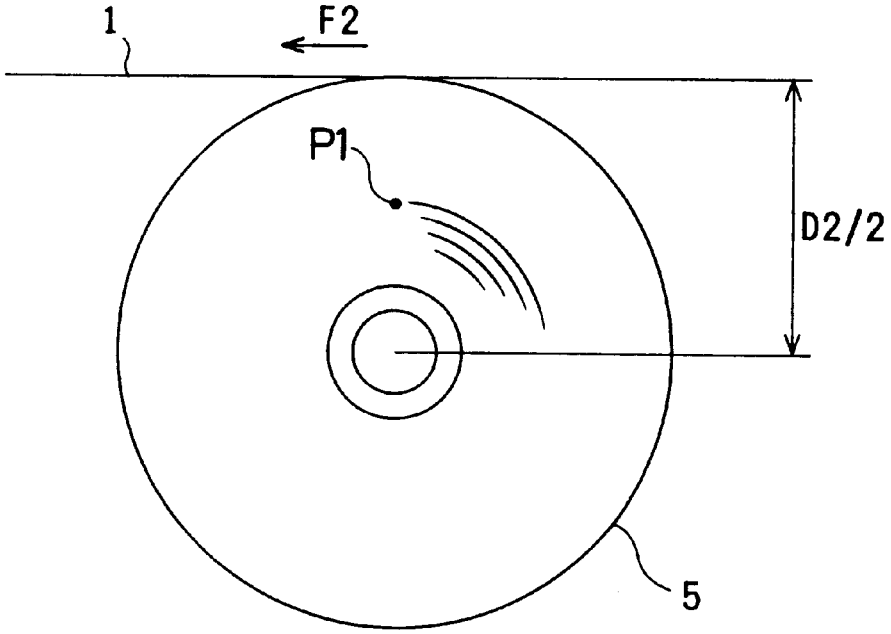
FIG. 6 is a diagram showing a final winding stage of the thin material.

Specifically, a winding torque T1 (F1×D1/2) acting on an outer circumference of the rolled thin material 5 in an intermediate stage of winding shown in FIG. 5 equals to a winding torque T2 (F2×D2/2) acting on an outer circumference of the rolled thin material 5 in a final stage of winding shown in FIG. 6. In other words, there is no likelihood that in the final winding stage, the winding torque becomes larger than the frictional resistance acting on the point P1 in the intermediate winding stage. Accordingly, the layer slip can be assuredly prevented. Thus, the finished roll of thin material will have a smooth side end surface.

Figure 4:
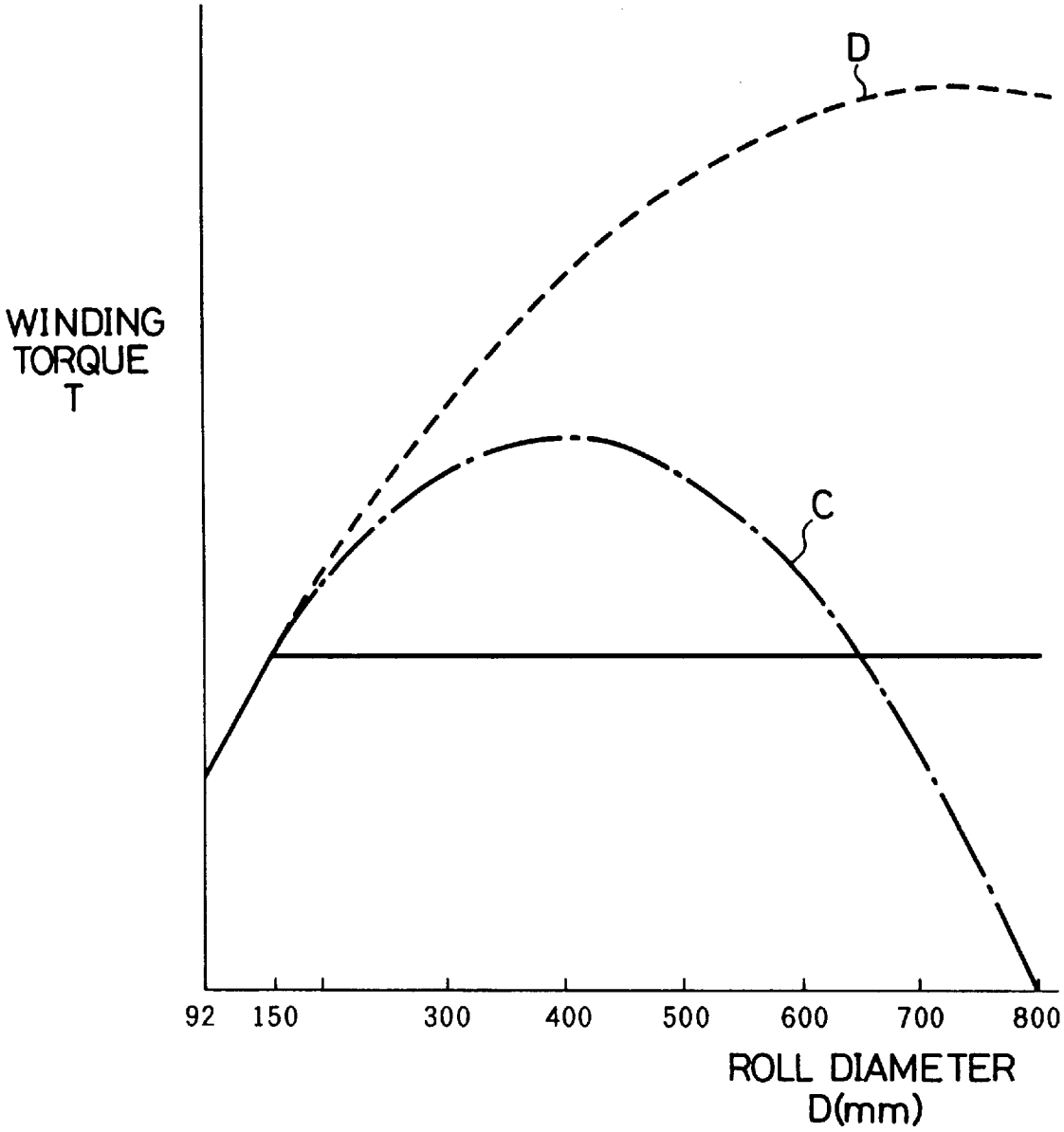
FIG. 4 is a graph showing a relationship between a winding torque and a diameter of the rolled thin material.

The broken lines A and B in FIGS. 3 and 4 show comparative examples 1 and 2. In the comparative example 1 shown by the dashed and broken line A in FIG. 3, the tension F is reduced linearly so that the tension F at a final stage becomes 0. As shown in the dashed and broken line C in FIG. 4, in the comparative example 1, the winding torque T increases in accordance with an increased diameter D of the rolled thin material 5 until the diameter of 400 mm. After the diameter of 400 mm, the winding torque T decreases in accordance with an increased diameter D of the rolled thin material 5. Accordingly, it will be seen that a layer slip will be liable to occur when the torque T reaches the maximum value at the diameter of 400 mm.

Also, in the comparative example 2 shown by the dashed line B in FIG. 3, the tension F is reduced linearly in accordance with an increased diameter D of the rolled thin material 5. In the final stage, the tension F is set at a half of the tension F0 of the initial stage. As shown in the dashed line D in FIG. 4, the torque T gradually increases in accordance with an increased diameter D of the rolled thin material 5. Accordingly, in the comparative example 2, the possibility of occurrence of layer slip will increase with the increase in the diameter D.

Further, in the comparative example 1 where the tension F at the final stage becomes 0, the thin material 1 cannot resist against a load of the transport device in the final stage, consequently resulting in a finished roll of thin material not having a necessary diameter.

On the other hand, in the inventive winding apparatus, the tension F is controlled in such a way that the product of the diameter D of the rolled thin material 5 and the tension F is constant. Accordingly, as the diameter D becomes larger, the reduction rate of the tension F to the diameter D is gradually decreased. Also, in the inventive winding apparatus, the tension at the final stage is not set at 0. Accordingly, a thin material can be assuredly wound up to a necessary roll diameter with a suitable tension resistible against the load of the transport device.

In this embodiment, as shown in FIG. 2, the tension F is maintained at the predetermined maximum value until the diameter D of the rolled thin material 5 reaches the predetermined reference value. This will assure a firm winding while preventing the likelihood that an excessively large tension expands the thin material and causes a plastic deformation in the thin material. Specifically, if the tension F is reduced inversely with an increased diameter D from the starting point without providing the constant zone as shown in the dashed line in FIG. 2, an excessively large tension is applied to the thin material at the start, thereby expanding the thin material. The holding of the tension at the suitable value in the initial winding stage prevents such undesirable expansion of the thin material while keeping firm winding.

Further, there is a possibility that the provision of the constant tension in the initial stage causes a layer slip. However, the diameter of the rolled thin material is very small in the initial stage. Accordingly, the layer slip in the initial stage causes no noticeable irregularity in the side end surface of the rolled thin material.

In this embodiment, the target tension value N corresponding to the diameter D is read out from the memory 9 based on a detection signal from the roll diameter detecting device 6. The tension detecting device 7 detects whether an actual tension F corresponding to the target tension value N is applied to the thin material. The driving torque of the drive motor 4 is controlled based on the detection result of the tension detecting device 7. Accordingly, even if the load to the drive motor 4 varies with a variation in the weight of the rolled thin material or the voltage of power source fluctuates, the driving torque of the drive motor 4 can be properly controlled.

In place of the arrangement that the driving torque of the drive motor 4 is controlled in accordance with a detection result of the tension detecting device 7, it may be possible to use a pre-set table defining a correspondence between a tension F varying with a diameter D and a driving torque of the drive motor 4. A suitable driving torque is read from the table and a control signal corresponding to the read driving torque is output to the drive motor 4 to make the product of a diameter D of the rolled thin material 5 and a tension F constant. In this case, however, it is difficult to execute control of driving torque in connection with a fluctuation in the power source voltage.

On the contrary, the control of driving torque on the basis of a detection of the tension detecting device 7 can effectively change the driving torque of the drive motor in accordance with a fluctuation in the power source voltage and in the load to the drive motor, thereby making it possible to reliably prevent the layer slip.

Further, in the case where the tension F is applied in inverse proportion to the diameter D of the rolled thin material and the pressing roller 51 is brought to the pressing contact with the thin material at an appropriate pressing force, the air can be effectively expelled from rolled layers. Thus, the layer slip can more reliably prevented.

Figure 7:
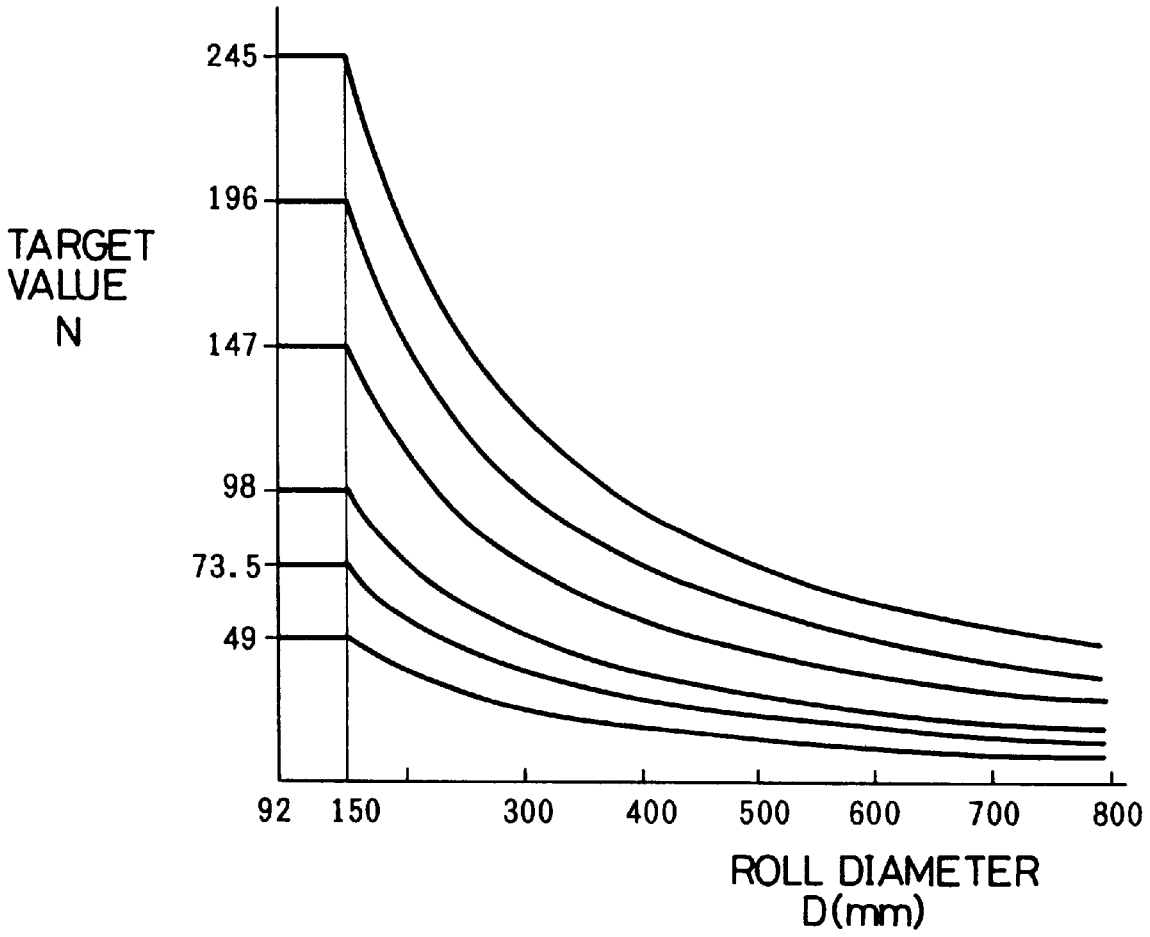
FIG. 7 is a graph showing relationships between a target tension value and a rolled thin material diameter, the relationships being stored in a memory of the winding apparatus.

As shown in FIG. 7, it may be appreciated to store a plurality of target tension value curves having different initial target tension values in the memory 9. In consideration of a friction coefficient and tensile strength of a thin material to be wound up, a suitable target tension value curve is selected.

The provision of the plurality of target tension value curves makes it possible to reliably prevent layer slips in winding up a variety of kinds of thin material. Specifically, in the case of winding up a thin material having a small friction coefficient, a target tension value curve having a large initial value is selected to ensure a tight winding of the thin material on the pipe 2.

Also, in the case of winding up a thin material having a small tensile strength and being liable to cause a plastic deformation, a target tension value curve having a small initial value is selected to prevent a plastic deformation and assuredly prevent a layer slip.

Figure 8:
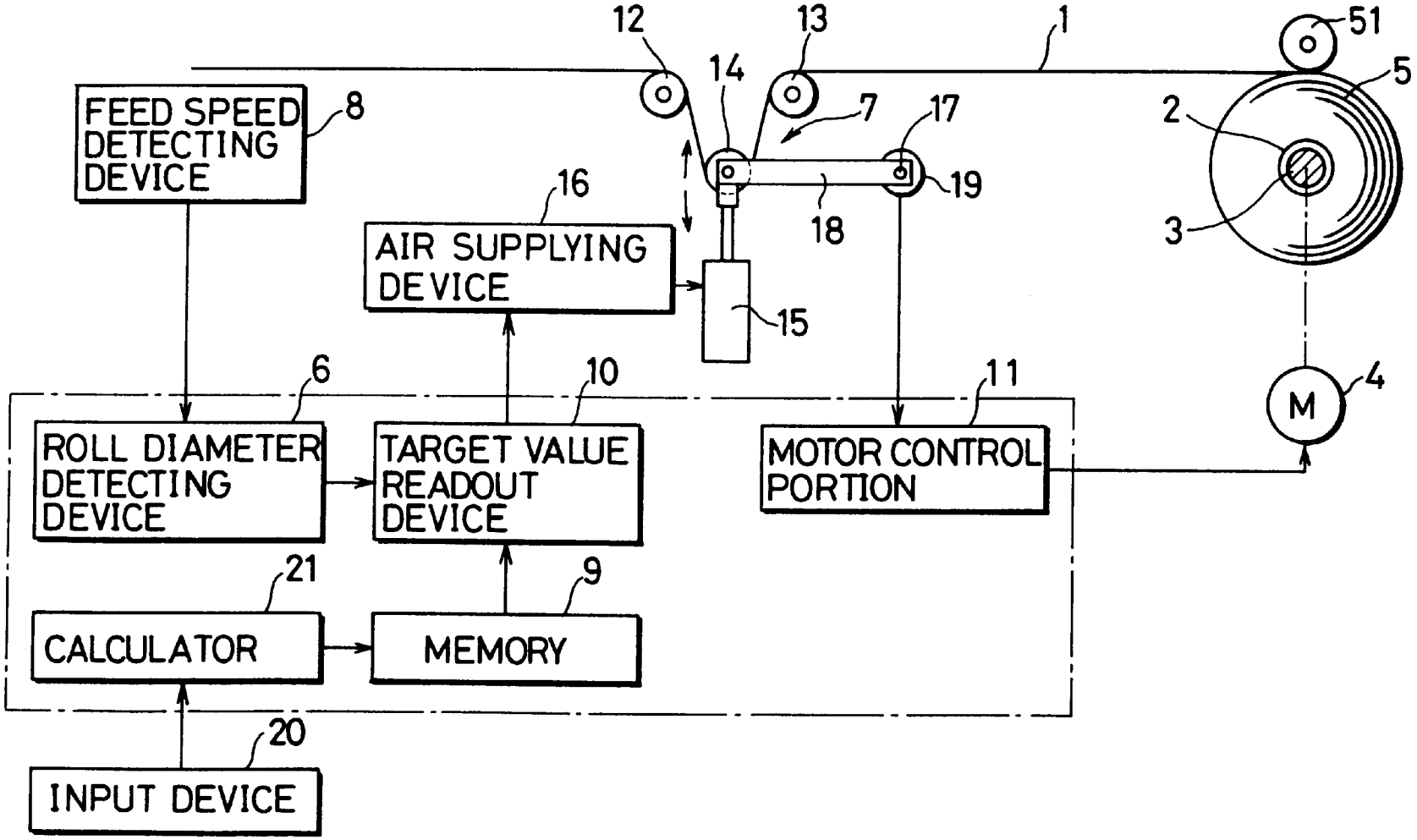
FIG. 8 is a diagram showing a construction of a second thin material winding apparatus according to the present invention.

As shown in FIG. 8, alternatively, it may be appreciated to provide an initial target tension value input device 20 for inputting an initial target tension value and a calculator 21 for calculating a target tension value curve based on the initial target tension value. The calculated target tension value curve is stored in the memory 9. This arrangement makes it possible to set a target tension value curve suitable to a friction coefficient or tensile strength of a given thin material more accurately. Accordingly, it is advantageous in precisely controlling the winding operation.

Figure 9:
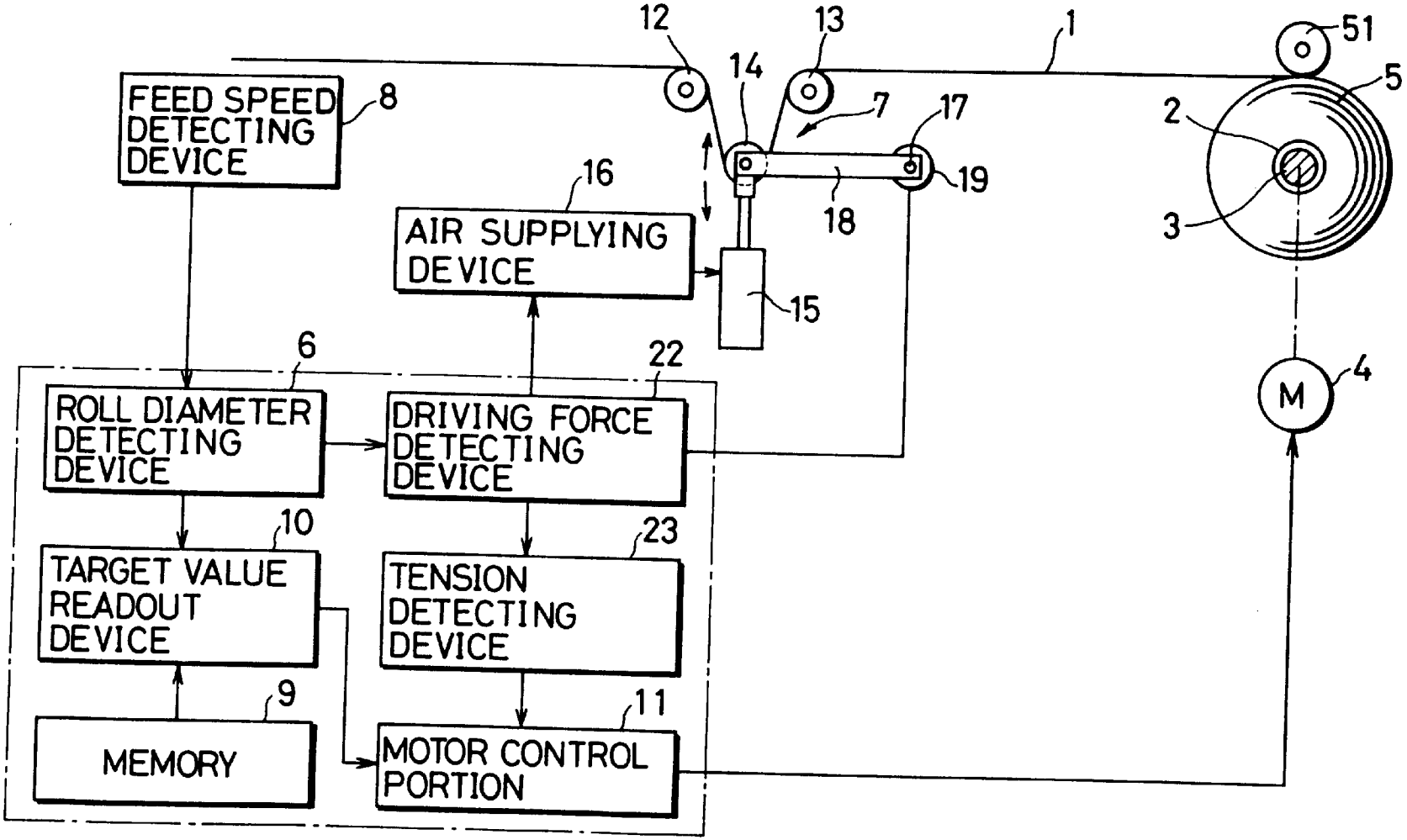
FIG. 9 is a diagram showing a construction of a third thin material winding apparatus according to the present invention.

In the foregoing embodiment, the air supplying device 16 supplies to the air cylinder 15 a specified air pressure corresponding to a target tension value N. It is detected based on a position of t he dancer roller 14 whether there is a tension corresponding to the target tension value on the thin material 1. However, alternatively, it may be appreciated, as shown in FIG. 9, to provide a driving force detecting device 22 for detecting a driving force of the air cylinder 15 necessary for retaining the dancer roller 14 at the neutral position, and a tension detecting device 23 for detecting a tension on the thin material based on an output signal of the driving force detecting device 22.

In this arrangement, a read out device 10 reads out a target tension value N based on a detection of a roll diameter detecting device 6 and a target tension value curve stored in the memory 9. A motor control portion 11 compares the read target tension value with a detected tension of the tension detecting device 23, and then sends a control signal to a drive motor 4 to eliminate a difference between the detected tension and the target tension value.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A thin strip material winding apparatus comprising:

a winding shaft for winding up a thin strip material into a roll of thin strip material;

a drive motor for driving the winding shaft; and a control unit comprising:

a diameter detecting device for detecting a diameter of the roll of thin strip material, a tension detecting device for detecting a tension on the thin strip material, a memory for storing a target tension value curve the target tension value curve having a constant value until the diameter of the roll of thin strip material reaches a predetermined diameter that is greater than an initial diameter of the roll of thin strip material, and the target tension value curve thereafter making a product of the diameter of the roll of thin strip material and the tension on the thin strip material substantially constant, a target tension readout device for determining the target tension based on the target tension value curve, and a drive motor control portion for controlling the drive motor so that the tension on the thin strip material substantially matches the target tension.

2. The apparatus of claim 1, wherein the control unit further includes:

an input device for inputting an initial target tension;

a calculator for calculating the target tension value curve based on the initial target tension; and a memory for storing the calculated target tension value curve.

3. The winding apparatus of claim 1, wherein the predetermined diameter is about 50% greater than the initial diameter of the roll.

4. A thin strip material winding apparatus, comprising:

a winding shaft for winding up a thin strip material into a roll of thin strip material;

a drive motor for driving the winding shaft; and a control unit including:

a memory for storing a plurality of target tension value curves, the target tension value curves each having a constant value until the diameter of the roll of thin strip material reaches a predetermined diameter that is greater than an initial diameter of the roll of thin strip material, and each of the target tension value curves thereafter making a product of the diameter of the roll of thin strip material and a tension on the thin strip material substantially constant, a target tension readout device for determining the target tension in accordance with a selected target tension value curve in the memory, and a drive motor control portion for controlling the drive motor so that the tension on the thin strip material substantially matches the target tension.

5. The apparatus of claim 4, further comprising a diameter detecting device for detecting the diameter of the roll of thin strip material.

6. The apparatus of claim 4, further comprising a tension detecting device for detecting a tension on the thin strip material.

7. The apparatus of claim 4, wherein the control unit further includes:

an input device for inputting an initial target tension;

a calculator for calculating a target tension value curve based on the initial target tension; and a memory for storing the calculated target tension value curve.

8. The winding apparatus of claim 4, wherein the predetermined diameter is about 50% greater than the initial diameter of the roll.

9. A method for winding a thin strip material, comprising:

driving a winding shaft with a drive motor to wind up the thin strip material into a roll on the winding shaft;

detecting a diameter of the roll;

detecting a tension on the thin strip material;

storing a target tension value curve, the target tension value curve having a constant value until the diameter of the roll reaches a predetermined diameter that is greater than an initial diameter of the roll, and the target tension value curve thereafter making a product of the diameter of the roll and the tension on the thin strip material substantially constant; and controlling the drive motor so that the tension on the thin strip material substantially matches the target tension value curve.

10. The method of claim 9, wherein the predetermined diameter is about 50% greater than the initial diameter of the roll.

11. A method for winding a thin strip material, comprising:

driving a winding shaft with a drive motor to wind up the thin strip material into a roll on the winding shaft;

detecting a diameter of the roll;

detecting a tension on the thin strip material;

storing a plurality of target tension value curves, the target tension value curves each having a constant value until the diameter of the roll reaches a predetermined diameter that is greater than an initial diameter of the roll, and each of the target tension value curves thereafter making a product of the diameter of the roll and the tension on the thin strip material substantially constant;

selecting a target tension value curve; and controlling the drive motor so that the tension on the thin strip material substantially matches the selected target tension value curve.

12. The method of claim 11, wherein the predetermined diameter is about 50% greater than the initial diameter of the roll.

* * * * *